US007730733B2

(12) United States Patent
Hwang et al.

(10) Patent No.: US 7,730,733 B2
(45) Date of Patent: Jun. 8, 2010

(54) APPARATUS AND METHOD OF SUMMING CAPACITIES OF OUTDOOR UNITS IN MULTIPLE AIR CONDITIONER

(75) Inventors: Ii Nahm Hwang, Kyungki-do (KR); Si Kyong Sung, Seoul (KR); Young Min Park, Inchun-si (KR); Pil Hyun Yoon, Seoul (KR); Jin Ha Choi, Kyungki-do (KR)

(73) Assignee: LG Electronics Inc., Seoul (KR)

( * ) Notice: Subject to any disclaimer, the term of this patent is extended or adjusted under 35 U.S.C. 154(b) by 1227 days.

(21) Appl. No.: 11/287,399

(22) Filed: Nov. 28, 2005

(65) Prior Publication Data

US 2006/0137372 A1 Jun. 29, 2006

(30) Foreign Application Priority Data

Dec. 22, 2004 (KR) ..... 10-2004-0110485

(51) Int. Cl.
*F25B 49/00* (2006.01)

(52) U.S. Cl. ..... 62/228.5; 62/228.1; 62/132

(58) Field of Classification Search ..... 62/228.1, 62/228.5, 132, 175
See application file for complete search history.

(56) References Cited

FOREIGN PATENT DOCUMENTS

JP 11037532 A * 2/1999

* cited by examiner

*Primary Examiner*—Chen-Wen Jiang
(74) *Attorney, Agent, or Firm*—Birch, Stewart, Kolasch & Birch, LLP

(57) ABSTRACT

An apparatus for summing capacities of outdoor units in a multiple air conditioner comprises self-capacity storage devices mounted in outdoor units, respectively, for storing self-capacities of the outdoor units and outputting the self-capacities of the outdoor units when necessary, an outdoor unit capacity summing part mounted in one outdoor unit of the outdoor units for receiving the capacities of the outdoor units outputted from the respective self-capacity storage devices to calculate the total capacity of all the outdoor units, and a control device for receiving the result of the calculation performed by the outdoor unit capacity summing part to control the operation of the multiple air conditioner. The possibility of incorrect input of the capacities of the outdoor units is eliminated, and therefore, more accurate control of the multiple air conditioner is accomplished. Furthermore, it is not necessary for an engineer or a user to directly input the capacities of the outdoor units, and therefore, user convenience is improved.

7 Claims, 3 Drawing Sheets

APPARATUS AND METHOD OF SUMMING CAPACITIES OF OUTDOOR UNITS IN MULTIPLE AIR CONDITIONER

BACKGROUND OF THE INVENTION

1. Field of the Invention

The present invention relates to a multiple air conditioner comprising a plurality of outdoor units and a plurality of indoor units, and, more particularly, to an apparatus and method of summing capacities of outdoor units of a multiple air conditioner, the apparatus and method being capable of automatically calculating the total capacity of the outdoor units to control the outdoor units.

2. Description of the Related Art

FIG. 1 is a block diagram showing an apparatus for summing capacities of outdoor units in a conventional multiple air conditioner.

As shown in FIG. 1, the conventional multiple air conditioner comprises a plurality of indoor units 10 and a plurality of outdoor units 20, which are connected to one another to perform a cooling or heating operation.

Although not shown in the drawing, an indoor heat exchanger, an indoor fan, and an expanding device are mounted in each of the indoor units 10, in the same manner as the construction of an air conditioner employing a normal cooling cycle. Similarly, a compressor, an outdoor heat exchanger, and an outdoor fan are also mounted in each of the outdoor units 20.

In the multiple air conditioner having the plurality of outdoor units as described above, the connected capacities of the plurality of indoor units 10 are restricted based on the capabilities of the compressor and the outdoor heat exchanger mounted in the each of the outdoor units.

In a main outdoor unit 21, which is one of the plurality of outdoor units 20, is mounted an outdoor unit control device 31 for controlling the operation of each of the outdoor units according to the connected capacities of the indoor units 10.

The capacity of each of the indoor units may be inputted through a dip switch mounted in each of the indoor units, or may be decided according to a program installed in an indoor unit control device. Consequently, when the indoor units 10 are operated, the total connected capacity $Q_{in}$ of the indoor units 10 connected to the outdoor units 20 is calculated by an indoor unit capacity summing device 33, which is also mounted in the main outdoor unit 21, through communication between the indoor units and the outdoor units, and then the calculated connected capacity $Q_{in}$ of indoor units 10 is recognized by the outdoor unit control device 31. Alternatively, total connected capacity $Q_{in}$ of the indoor units 10 may be calculated by directly inputting the capacities of the indoor units through the dip switches.

Especially, the total capacity of the plurality of outdoor units 20 is decided according to the capacities of the compressors and the outdoor heat exchangers mounted in the outdoor units 21, 22, 23, and 25. It is required that the capacities of the compressors and the outdoor heat exchanges are decided according to operation logic although the compressors are the same and the outdoor heat exchangers are also the same.

When the plurality of outdoor units 20 are connected, one of the outdoor units 20 is classified as the main outdoor unit 21, and other outdoor units 22, 23, and 25 are classified as subsidiary outdoor units. The sum of the capacities of the outdoor units 20 is directly calculated by an engineer or a user, and is then inputted to the main outdoor unit 21. Alternatively, the sum of the capacities of the outdoor units 20 may be inputted to the main outdoor unit 21 through an outdoor unit capacity input device 32, such as a dip switch, with reference to an operation manual.

Based on the sum $Q_{out}$ of the capacities of the outdoor units 20 inputted as described above, necessary controlling operations, such as compressor capacity calculation, sequential control mode, and control target value, are performed.

According to the method of summing the capacities of the outdoor units in the conventional multiple air conditioner, however, incorrect sum of capacities may be inputted due to errors of an engineer who initially installs the conventional multiple air conditioner. If the sum $Q_{out}$ of the capacities of the outdoor units 20 is incorrectly inputted, accurate control is not accomplished when the necessary controlling operations, such as compressor capacity calculation, sequential control mode, and control target value, are performed.

Even if the sum $Q_{out}$ of the capacities of the outdoor units 20 is correctly inputted at the beginning, the initial sum of the capacities may be changed due to incorrect manipulation or input of a user. In this case, control is not accurately performed.

SUMMARY OF THE INVENTION

Therefore, the present invention has been made in view of the above problems, and it is an object of the present invention to provide an apparatus for summing capacities of outdoor units in a multiple air conditioner that is capable of automatically calculating and storing the total capacity of the outdoor units when the multiple air conditioner is operated with self-capacities stored in the outdoor units to operate the air conditioner, thereby accomplishing accurate calculation of the total capacity of the outdoor units, and therefore improving operational reliability of the air conditioner.

It is another object of the present invention to provide a method of summing capacities of outdoor units in a multiple air conditioner that is capable of automatically calculating and storing the total capacity of the outdoor units when the multiple air conditioner is operated with self-capacities stored in the outdoor units to operate the air conditioner, thereby accomplishing accurate calculation of the total capacity of the outdoor units, and therefore improving operational reliability of the air conditioner.

In accordance with one aspect of the present invention, the above and other objects can be accomplished by the provision of an apparatus for summing capacities of outdoor units in a multiple air conditioner, the apparatus comprising: self-capacity storage devices mounted in outdoor units, respectively, for storing self-capacities of the outdoor units and outputting the self-capacities of the outdoor units when necessary; an outdoor unit capacity summing part mounted in one outdoor unit of the outdoor units for receiving the capacities of the outdoor units outputted from the respective self-capacity storage devices to calculate the total capacity of all the outdoor units; and a control device for receiving the result of the calculation performed by the outdoor unit capacity summing part to control the operation of the multiple air conditioner.

Preferably, the capacity of each of the outdoor units is decided based on the capacity of a compressor or an outdoor heat exchanger mounted in each of the outdoor units.

Preferably, each of the self-capacity storage devices comprises: a self-capacity storage part in each of the outdoor units for storing the self-capacity of each of the outdoor units; and a capacity output part for outputting the capacity stored in the self-capacity storage part.

Preferably, the control device is connected to an indoor unit capacity summing part for receiving the result of the sum of capacities of indoor units calculated by the indoor unit capacity summing part.

In accordance with another aspect of the present invention, there is provided a method of summing capacities of outdoor units in a multiple air conditioner, the method comprising: a first step of transmitting self-capacities of subsidiary outdoor units to an outdoor unit capacity summing part mounted in a main outdoor unit through communication between the main outdoor unit and the subsidiary outdoor units; a second step of adding the capacities of the subsidiary outdoor units received from the subsidiary outdoor units to the capacity of the main outdoor unit at the outdoor unit capacity summing part and storing the total capacity of all the outdoor units in an outdoor door control device; and a third step of controlling the operation of the multiple air conditioner according to the total capacity of all the outdoor units stored in the outdoor door control device.

Preferably, the first and second steps are performed within a predetermined period of time after a power switch is turned on to operate the multiple air conditioner.

When the predetermined period of time elapses after the power switch is turned on, the total capacity of the outdoor units is no longer calculated, and the third step is performed with the stored total capacity of the outdoor units.

When the power switch is turned off to stop the operation of the multiple air conditioner, the stored total capacity of the outdoor units is deleted, and, when the power switch is turned on again to operate the multiple air conditioner, the first and second steps are performed, whereby the total capacity of the outdoor units stored.

According to the present invention, the self-capacity is stored in each of the outdoor units, and the total capacity of the outdoor units is automatically calculated and stored through communication between the outdoor units. As a result, the possibility of incorrect input of the capacities of the outdoor units is eliminated, and therefore, more accurate control of the multiple air conditioner is accomplished. Furthermore, it is not necessary for an engineer or a user to directly input the capacities of the outdoor units, and therefore, user convenience is improved.

In addition, when additional outdoor units are to be installed, the capacities of the additional outdoor units are automatically added to the capacities of the existing outdoor units, and the total capacity of the outdoor units is calculated and stored so long as the added outdoor units are connected to the circuit of the air conditioner system. Consequently, addition or removal of the outdoor units is easily and conveniently accomplished.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the accompanying drawings.

Figure 1:
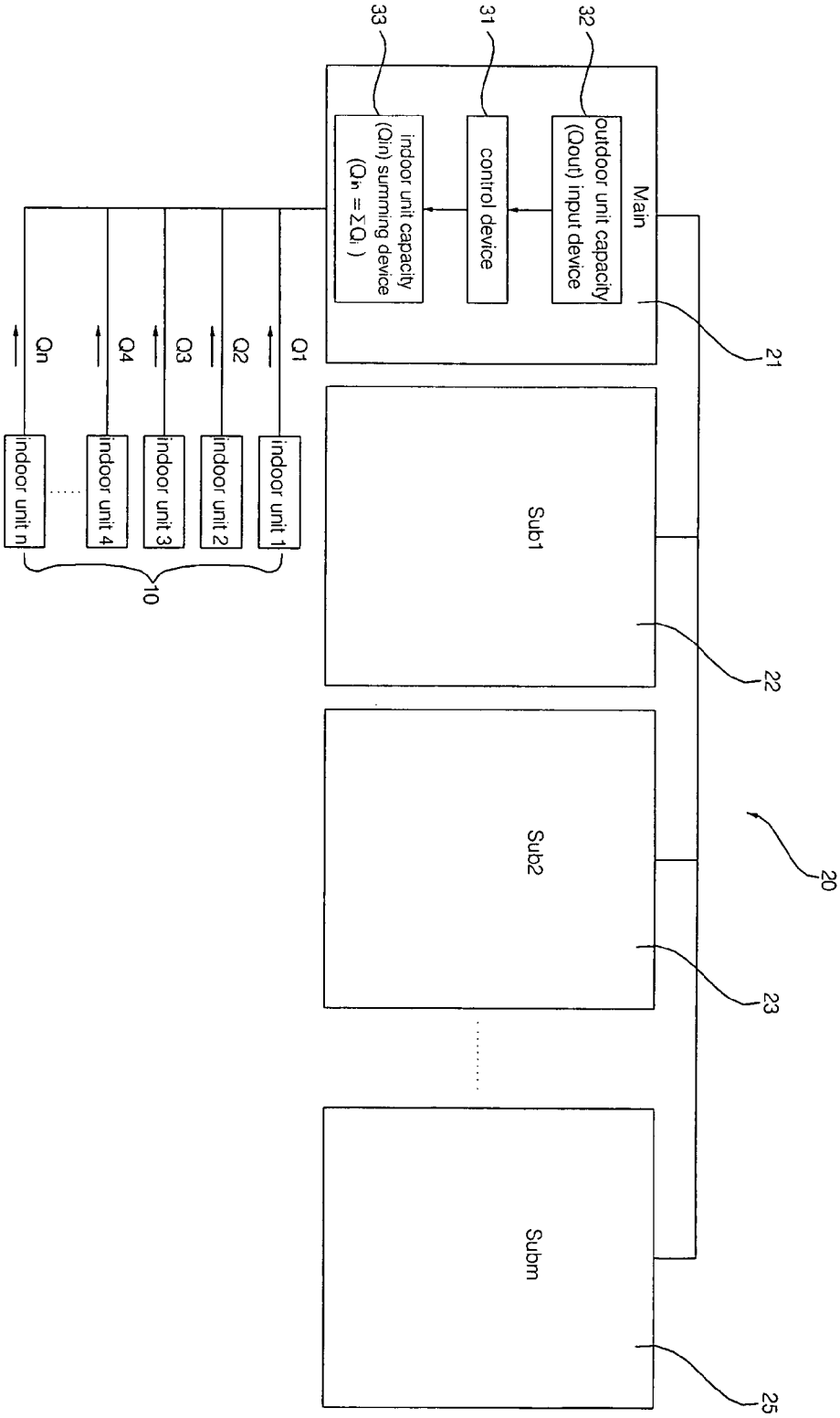
FIG. 1 (Prior Art)
FIG. 1 is a block diagram showing an apparatus for summing capacities of outdoor units in an conventional multiple air conditioner.
Figure 2:
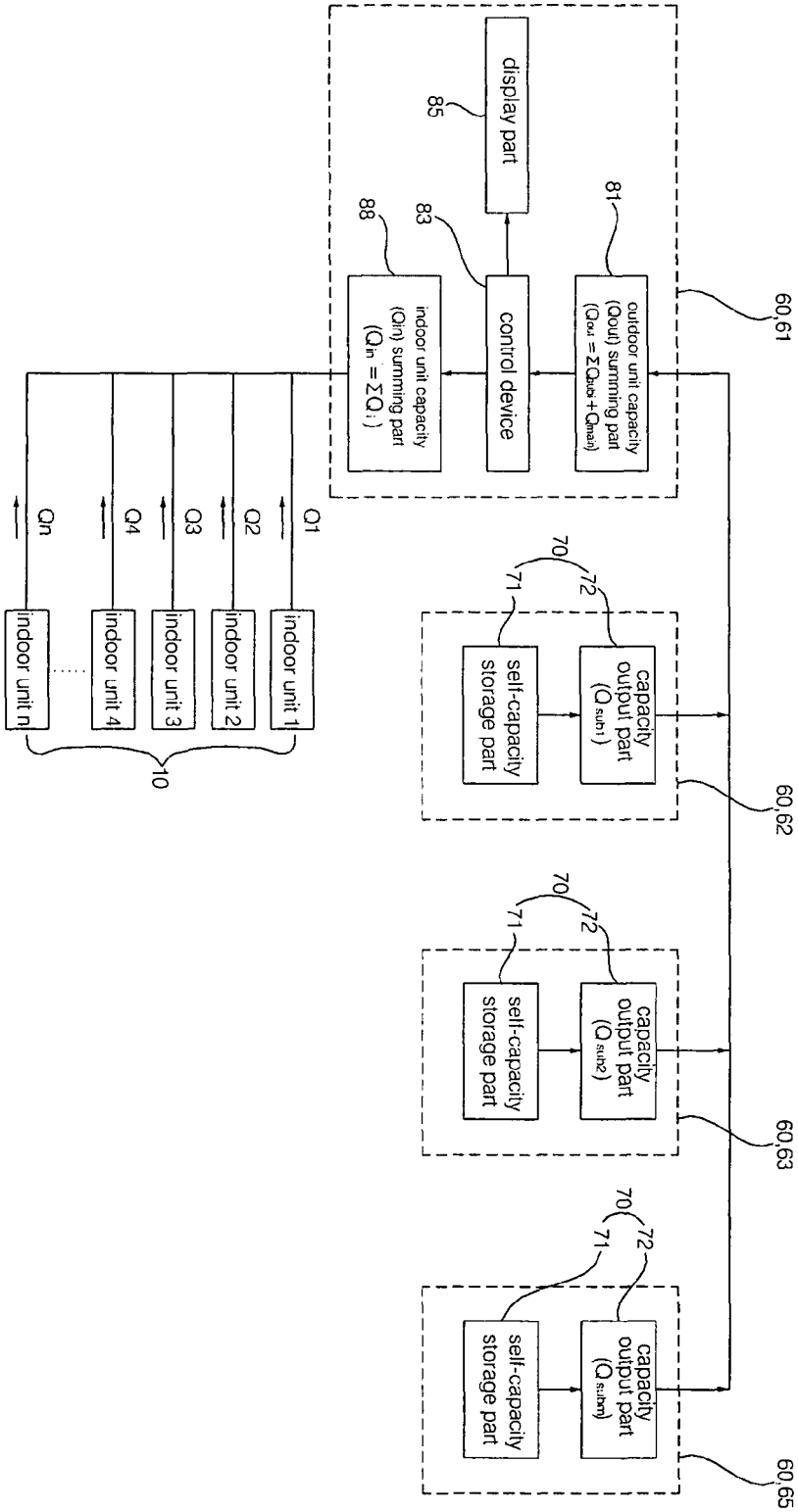
FIG. 2 is a block diagram showing an apparatus for summing capacities of outdoor units in a multiple air conditioner according to the present invention.

FIG. 2 is a block diagram showing an apparatus for summing capacities of outdoor units in a multiple air conditioner according to the present invention.

As shown in FIG. 2, the multiple air conditioner comprises a plurality of indoor units 50 and a plurality of outdoor units 60, which are connected to one another to perform a cooling or heating operation according to a cooling cycle.

A self-capacity storage device 70 is mounted in each of outdoor units 62, 63, and 65, among the plurality of outdoor units 60, for storing self-capacity of each of the outdoor units 62, 63, and 65 and outputting the self-capacity of each of the outdoor units 62, 63, and 65 when necessary.

One of the outdoor units 60 is classified as a main outdoor unit 61, and other outdoor units 62, 63, and 65 are classified as subsidiary outdoor units. The self-capacity storage device 70 is mounted in each of the subsidiary outdoor units 62, 63, and 65.

The capacity of each of the outdoor units, which is stored by the self-capacity storage device 70, is decided based on the capacity of a compressor or an outdoor heat exchanger mounted in each of the outdoor units. Specifically, the capacity of each of the outdoor units 62, 63, and 65 is decided based on either the capacity of the compressor mounted in each of the outdoor units 62, 63, and 65 or the capacity of the outdoor heat exchanger mounted in each of the outdoor units 62, 63, and 65. Preferably, the capacity of each of the outdoor units 62, 63, and 65 is decided based on the sum of the capacities of the compressor and the outdoor heat exchanger calculated in a proper ratio.

The self-capacity storage device 70 is preferably mounted in a control device for controlling the compressor and an outdoor fan in each of the outdoor units 62, 63, and 65. The self-capacity storage device 70 comprises: a self-capacity storage part 71 for storing the self-capacity of each of the outdoor units 62, 63, and 65; and a capacity output part 72 for outputting the capacity stored in the self-capacity storage part 71 to the main outdoor unit 61.

In the main outdoor unit 61 is mounted an outdoor unit capacity summing part 81 for receiving the capacities of the outdoor units 62, 63, and 65 outputted from each self-capacity storage device 70 to calculate the total capacity of all the outdoor units 60.

Preferably, the outdoor unit capacity summing part 81 includes a self-capacity storage program, which performs the same function as the self-capacity storage device 70 mounted in each of the subsidiary outdoor units 62, 63, and 65.

In the main outdoor unit 61 is also mounted an indoor unit capacity summing part 88 for receiving the capacities of the indoor units 50, through communication with the plurality of the indoor units 50, to sum the capacities of the indoor units 50.

Especially in the main outdoor unit 61 is mounted a control device 83 for receiving the result of the sum of capacities of the outdoor units calculated by the outdoor unit capacity summing part 81 and the result of the sum of capacities of the indoor units calculated by the indoor unit capacity summing part 88 to control the operation of the multiple air conditioner.

The control unit 83 decides the capabilities of the compressors mounted in the respective outdoor units 60 according to the total connected capacity of the indoor units 50, and performs necessary controlling operations, such as compressor capacity calculation, sequential control mode, and control target value, based on the sum $Q_{out}$ of the capacities of the outdoor units 60.

In the main outdoor unit 61 is also mounted a display part 85 for allowing the engineer or the user to confirm the result of the sum of the outdoor units calculated by the outdoor unit capacity summing part 81.

The display part 85 is directly connected to the outdoor unit capacity summing part 81 for receiving a signal from the outdoor unit capacity summing part 81. Alternatively, the display part 85 may be configured to receive a signal through the control unit 83.

Now, a method of summing capacities of outdoor units in a multiple air conditioner according to the present invention using the apparatus for summing capacities of the outdoor units in the multiple air conditioner with the above-stated construction according to the present invention will be described.

Figure 3:
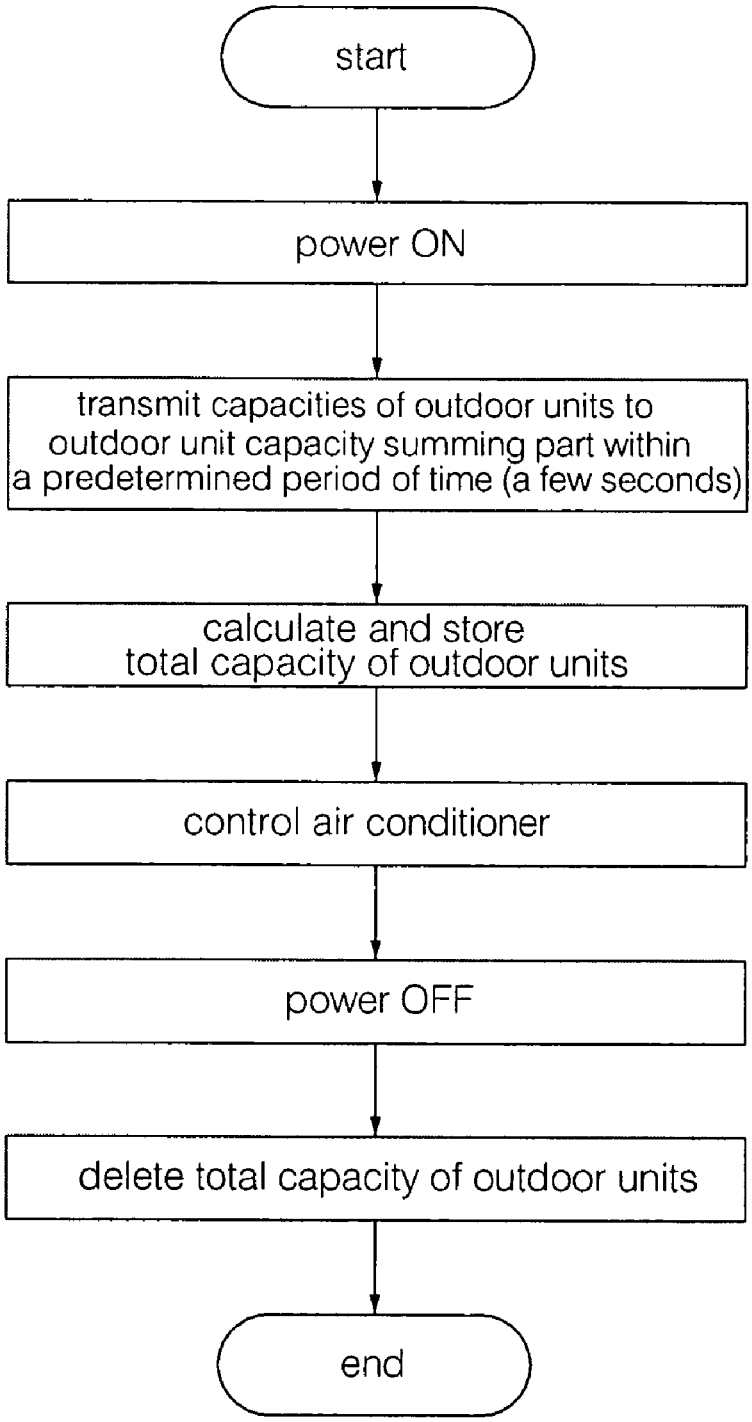
FIG. 3 is a flow chart illustrating a method of summing capacities of outdoor units in a multiple air conditioner according to the present invention.

FIG. 3 is a flow chart illustrating the method of summing capacities of the outdoor units in the multiple air conditioner according to the present invention.

When a power switch is turned on to operate the multiple air conditioner, communication between the subsidiary outdoor units 62, 63, and 65 and the main outdoor unit 61 is performed, and the self-capacity stored in the self-capacity storage part 71 of each of the outdoor units is transmitted to the outdoor unit capacity summing part 81 of the main outdoor unit 61 through the corresponding capacity output part 72 within a predetermined period of time, for example, a few seconds.

The outdoor unit capacity summing part 81 of the main outdoor unit 61 adds the self-capacity stored in the program of the outdoor unit capacity summing part 81 to the capacities of the subsidiary outdoor units received from the subsidiary outdoor units 62, 63, and 65 to calculate the total capacity $Q_{out}$ of the outdoor units 60. The total capacity of the outdoor units 60 is stored in the outdoor unit capacity summing part 81 or the control device 83.

As described above, when the multiple air conditioner is operated, the capacities of the subsidiary outdoor units 62, 63, and 65 are added to the capacity of the main outdoor unit 61 to calculate the total capacity of the outdoor units 60. In this way, the total capacity of the outdoor units 60 is automatically calculated and stored without additional input by a user or an engineer.

The total capacity $Q_{out}$ of the outdoor units 60 stored in the outdoor unit capacity summing part 81 or the control device 83 is displayed on the display part 85 such that the user or the engineer recognizes the total capacity of the outdoor units 60.

When the multiple air conditioner is normally operated a predetermined period of time after the power switch is turned on, the total capacity $Q_{out}$ of the outdoor units 60 is no longer calculated, and the controlling operation of the multiple air conditioner is performed with the stored total capacity of the outdoor units 60.

The communication between the main outdoor unit 61 and the subsidiary outdoor units 62, 63, and 65 is performed for only a few seconds after the power switch is turned on in order to prevent deletion of outdoor unit capacity information when the communication between the main outdoor unit 61 and the subsidiary outdoor units 62, 63, and 65 is stopped. Consequently, after the total capacity of the outdoor units is calculated and stored, additional calculation is no longer performed, and the operation of the air conditioner is controlled based on the stored total capacity of the outdoor units until the power switch is turned off to stop the operation of the air conditioner.

Meanwhile, the control device 83 of the main outdoor unit 61 receives the result of the total connected capacity $Q_{in}$ of the indoor units, which are being operated, through the indoor unit capacity summing part 88, and decides which outdoor units 60 are to be operated based on the total connected capacity of the indoor units 50.

When the power switch is turned off to stop the operation of the multiple air conditioner, the stored total capacity $Q_{out}$ of the outdoor units 60 is deleted. When the power switch is turned on again to operate the multiple air conditioner, communication between the main outdoor unit 61 and the subsidiary outdoor units 62, 63, and 65 is performed, and the above-described control procedure is carried out.

As apparent from the above description, the self-capacity is stored in each of the outdoor units, and the total capacity of the outdoor units is automatically calculated and stored through communication between the outdoor units. As a result, the possibility of incorrect input of the capacities of the outdoor units is eliminated, and therefore, more accurate control of the multiple air conditioner is accomplished. Furthermore, it is not necessary for an engineer or a user to directly input the capacities of the outdoor units, and therefore, user convenience is improved.

In addition, when additional outdoor units are to be installed, the capacities of the addition outdoor units are automatically added to the capacities of the existing outdoor units, and the total capacity of the outdoor units is calculated and stored so long as the added outdoor units are connected to the circuit of the air conditioner system. Consequently, addition or removal of the outdoor units is easily and conveniently accomplished.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for summing capacities of outdoor units in a multiple air conditioner, the apparatus comprising:

self-capacity storage devices mounted in a plurality of subsidiary outdoor units, respectively, for storing self-capacities of the subsidiary outdoor units and outputting the self-capacities of the subsidiary outdoor units when necessary;

an outdoor unit capacity summing part mounted in a main outdoor unit for receiving the capacities of the subsidiary outdoor units outputted from the respective self-capacity storage devices to calculate the total capacity of all the outdoor units;

a control device for receiving the result of the calculation performed by the outdoor unit capacity summing part to control the operation of the multiple air conditioner; and a display part mounted in the main outdoor unit to display the result of the sum of the outdoor units calculated by the outdoor unit capacity summing part.

2. The apparatus as set forth in claim 1, wherein the capacity of each of the subsidiary outdoor units is decided based on the capacity of a compressor or an outdoor heat exchanger mounted in each of the subsidiary outdoor units.

3. The apparatus as set forth in claim 1, wherein each of the self-capacity storage devices comprises: a self-capacity storage part in each of the subsidiary outdoor units for storing the self-capacity of each of the subsidiary outdoor units; and a capacity output part for outputting the capacity stored in the self-capacity storage part.

4. The apparatus as set forth in claim 1, wherein the control device is connected to an indoor unit capacity summing part for receiving the result of the sum of capacities of indoor units calculated by the indoor unit capacity summing part.

5. The apparatus as set forth in claim 4, wherein the capacity of each of the subsidiary outdoor units is decided based on the capacity of a compressor or an outdoor heat exchanger mounted in each of the subsidiary outdoor units.

6. The apparatus as set forth in claim 4, wherein each of the self-capacity storage devices comprises:

a self-capacity storage part in each of the subsidiary outdoor units for storing the self-capacity of each of the subsidiary outdoor units; and a capacity output part for outputting the capacity stored in the self-capacity storage part.

7. The apparatus as set forth in claim 4, wherein the control unit decides the capabilities of the compressors mounted in the respective outdoor units according to the total connected capacity of the indoor units, and performs necessary controlling operations based on the sum of the capacities of the outdoor units.

* * * * *